United States Patent [19]

Maassen

[11] 4,155,513

[45] May 22, 1979

[54] DOUBLE-SIDED TEXTILE MACHINE WITH CHEESE WINDING DEVICES

[75] Inventor: Wilhelm Maassen, Mönchen-Gladbach, Fed. Rep. of Germany

[73] Assignee: W. Schlafhorst & Co., Mönchen-Gladbach, Fed. Rep. of Germany

[21] Appl. No.: 934,679

[22] Filed: Aug. 18, 1978

[30] Foreign Application Priority Data

Aug. 20, 1977 [DE] Fed. Rep. of Germany ..... 2737645

[51] Int. Cl.[2] ..... B65H 54/20; B65H 54/26; B65H 67/06; D01H 9/10

[52] U.S. Cl. ..... 242/35.5 A; 57/270

[58] Field of Search ..... 242/35.5 A, 35.5 R, 242/35.6 R; 57/52, 53, 54; 214/301, 302, 16 B, 500; 198/348, 362, 366

[56] References Cited

U.S. PATENT DOCUMENTS

| | | | |
|---|---|---|---|
| 3,099,410 | 7/1963 | Chambley | 242/35.5 R |
| 3,774,859 | 11/1973 | Brouwer et al. | 242/35.5 R |
| 3,811,631 | 5/1974 | Mayer et al. | 242/35.5 A X |
| 3,820,730 | 6/1974 | Endo et al. | 242/35.5 A X |
| 3,911,657 | 10/1975 | Bell et al. | 242/35.6 R X |
| 3,913,853 | 10/1975 | Raasch | 242/35.5 R |
| 4,010,907 | 3/1977 | Nishiyama et al. | 242/35.5 A |
| 4,066,218 | 1/1978 | Kamp | 242/35.5 A |
| 4,079,898 | 3/1978 | Murakami et al. | 242/35.5 A |
| 4,116,395 | 9/1978 | Courvoisier | 242/35.5 A |

FOREIGN PATENT DOCUMENTS

| | | | |
|---|---|---|---|
| 2506291 | 8/1976 | Fed. Rep. of Germany | 242/35.5 A |

*Primary Examiner*—Stanley N. Gilreath
*Attorney, Agent, or Firm*—Herbert L. Lerner

[57] ABSTRACT

Double-sided textile machine with cheese-winding devices including a separate, traveling automatic coil exchanger associated with each of the sides of the textile machine, a coil-core magazine entrainable by each of the coil exchangers, and a common coil-core loading station located at an end of the machine for supplying the coil-core magazines of both of the coil exchangers with coil cores.

7 Claims, 1 Drawing Figure

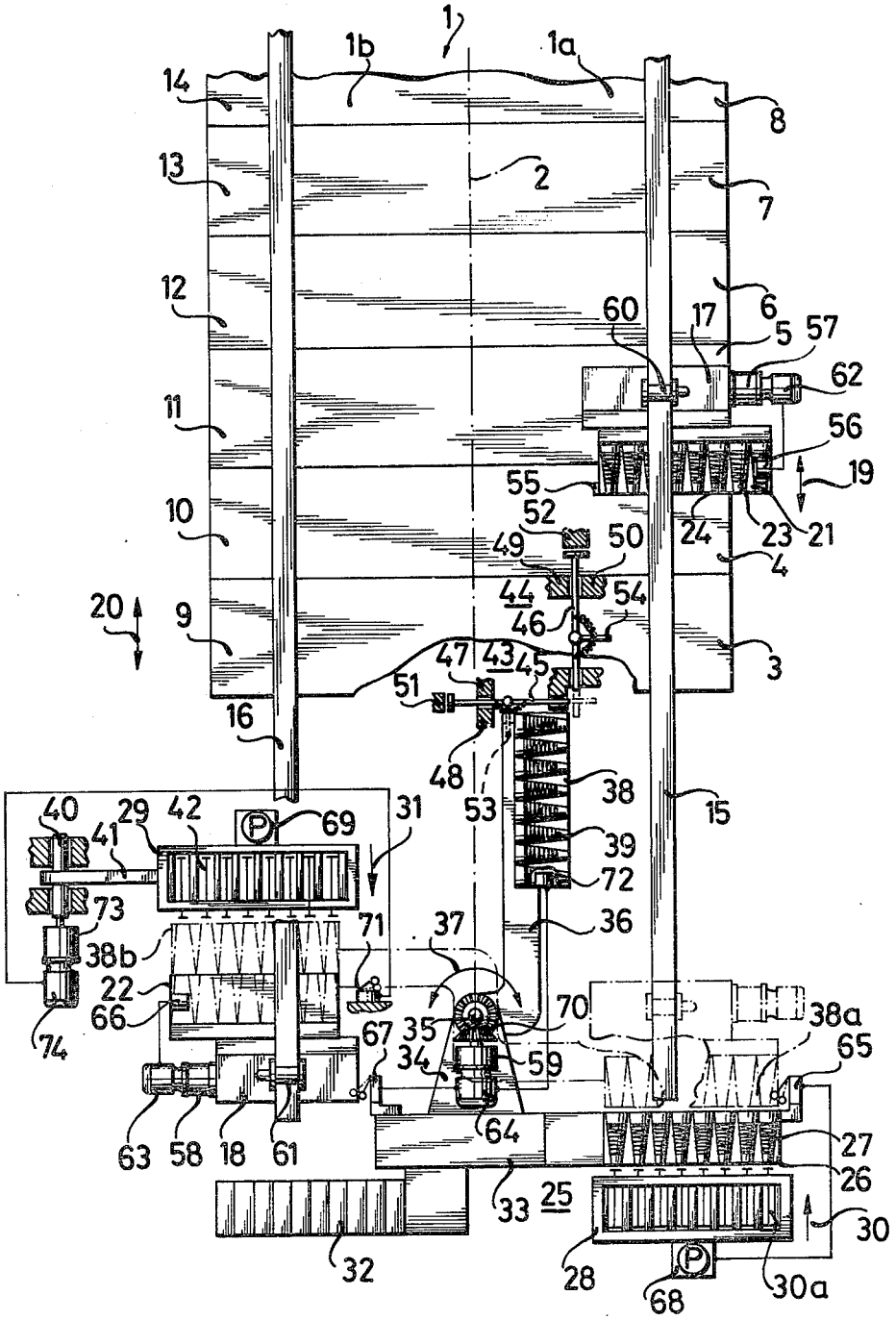
1
1b
1a
14
8
13
2
7
12
60
17
6
5
57
62
11
56
19
55
52
24
23
21
10
49
50
4
44
54
20
9
46
47
43
45
3
51
16
48
38
53
15
40
29
42
69
31
41
39
72
73
71
37
36
38b
22
70
38a
66
35
67
65
74
34
59
64
63
58
18
61
27
26
33
25
30
32
28
68
30a

DOUBLE-SIDED TEXTILE MACHINE WITH CHEESE WINDING DEVICES

The invention relates to a double-sided textile machine with a device for winding cross-wound coils or cheeses, such as a rotor spinning frame, especially.

It has been known heretofore to provide automatic coil exchangers for both machine sides of such textile machines.

For example, coil exchangers which are disposed so as to be displaceable along a winding or open-end spinning machine and, when necessary, exchange a full cross-wound coil or cheese for an empty coil or one wound with starting winding, have become known heretofore. Servicing both sides of the machine is made possible by providing for the travel path or track of the coil exchanger to be formed arcuately from one side of the machine to the other.

Such coil exchangers carry with them a predetermined supply of empty coil cores or tubes. At the one end of the travel path or track, which is laid out in the form of an open U, the core supply of the coil exchanger can be replenished.

The number of adjacent work stations of the two machine sides of a double-sided textile machine is limited by the capacity of the coil exchanger, i.e., by the winding time required for each cross-wound coil or cheese, the operating time of the automatic coil exchanger required for each cross-wound coil exchange, the velocity of travel of the coil exchanger and the shutdown time of the coil exchanger required for taking over new coil cores. There are other influencing factors independent of the coil exchanger yet affecting the capacity thereof, however, they will not be dealt with in detail here.

It is an object of the invention to provide a double-sided textile machine wherein the number of mutually adjacent work stations on the two machine sides thereof are increased while avoiding the aforementioned disadvantages of the heretofore known machines of this general type and without disadvantages consequences for the capacity of the coil exchanger and, therewith also the space requirement of a multiplicity of similar textile machines per work station is markedly reduced.

With the foregoing and other objects in view, there is provided, in accordance with the invention, a double-sided textile machine with cheese-winding devices comprising a separate, traveling automatic coil exchanger associated with each of the sides of the textile machine, a coil-core magazine entrainable by each of the coil exchangers, and a common coil-core loading station located at an end of the machine for supplying the coil-core magazines of both of the coil exchangers with coil cores.

In accordance with another feature of the invention, the core loading station is disposed so as to directly supply coil cores to the core magazine of the coil exchanger associated with one of the sides of the textile machine, and including an intemediate magazine for supplying coil cores to the core magazine of the coil exchanger associated with the other of the sides of the textile machine, the intermediate magazine being pivotable about a vertical axis into respective positions at the one machine side whereat it is loadable with coil cores by the core loading station and at the other machine side whereat coil cores are unloadable therefrom in a manner that the tips of the coil cores when being unloaded extend in a direction opposite that of the tips of the coil cores when being loaded.

In accordance with a further feature of the invention, the intermediate magazine has three normal set positions, namely, a loading position wherein it is disposed within displacement range of the coil exchanger associated with the one side of the textile machine in front of the core loading station, a rest position into which it is pivotable through substantially 90° from the loading position thereof and is disposed beyond displacement ranges of both the coil exchangers respectively associated with the two sides of the textile machine, and a transfer position wherein it is disposed within the displacement range of the coil exchanger associated with the other side of the textile machine in readiness for transfer.

In accordance with an added feature of the invention, the textile machine includes a coil-core transporter associated with the intermediate magazine and pivotable into displacement range of one of the coil exchangers for transferring coil cores from the intermediate magazine into the coil-core magazine of the one coil exchanger.

In accordance with an additional feature of the invention, the textile machine includes a coil-core transporter associated with the intermediate magazine and pivotable into displacement range of the coil exchanger associated with the other side of the textile machine for transferring coil cores from the intermediate magazine into the coil-core magazine of the coil exchanger associated with the other side of the textile machine.

In accordance with yet another feature of the invention, the textile machine includes a first latching device for one of the coil exchangers, the first latching device being disposed within pivot range of the intermediate magazine and actuatable by the intermediate magazine, and a second latching device for the intermediate magazine, the second latching device being disposed within displacement range of the one coil exchanger and actuatable by the one coil exchanger.

In accordance with a concomitant feature of the invention, the textile machine includes a first latching device for the coil exchanger associated with the one side of the textile machine the first latching device being disposed within pivot range of the intermediate magazine and being actuatable by the intermediate magazine, and a second latching device for the intermediate magazine, the second latching device being disposed within displacement range of coil exchanger associated with the one side of the textile machine and being actuatable by the coil exchanger associated with the one side of the textile machine.

The invention offers not only the advantage of constructing larger machine units requiring less space, but also the further advantage that both coil exchangers can be supplied through one core loading station. The invention also permits completely identical construction of the two coil exchangers. By means of the new intermediate magazine, as many coil cores as a coil exchanger can take up are transported from the one machine side to the other and are simultaneously turned through 180 degrees, so that even conical coil cores can always be transfered to the second coil changer with the tips of the cores oriented in the right manner. The turning or pivoting of the intermediate magazine and the shifting of the intermediate magazine from one machine side to the other can be effected by two completely separate operation. Advantageously, in accordance with the invention, however, this is accomplished in one operation by one and the same device.

In rest position, the intermediate magazine is disposed so that both coil exchangers can travel unimpeded into the loading position thereof. A separate core transporter can be swung into the displacement range of the second coil exchanger, the moment the latter coil exchanger demands coil cores and the intermediate magazine is swung into the transfer position. The interlocks or latches constructed in accordance with the invention ensure that the coil exchanger and the intermediate magazine do not interfere with the respective travel or displacement thereof.

Other features which are considered as characteristic for the invention are set forth in the appended claims.

Although the invention is illustrated and described herein as embodied in a double-sided textile machine with cheese winding devices, it is nevertheless not intended to be limited to the details shown, since various modification and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic top plan view of a double-sided textile machine embodying the invention of the instant application.

Referring now to the drawing, there is shown therein a double-sided textile machine 1, having machine sides 1*a* and 1*b*, which are separated from one another by a central plane 2 of the machine 1. On the right-hand machine side 1*a* there are provided winding stations 3 and 8, and on the left-hand machine side 1*b*, winding stations 9 to 14. Details of such winding stations are assumed to be well known in the art and are therefore not shown. At the various winding stations 3 to 14, conical cross-wound coils or cheeses of conventional dimensions are to be wound.

Above the machine side 1*a*, there is provided a track 15 for a first coil exchanger 17, and above the machine side 1*b*, a track 16 for a second coil exchanger 18. The first coil exchanger 17 can travel in direction of the double arrow 19, and the second coil exchanger 18 in direction of the double arrow 20. The coil exchanger 17 carries a tube or core magazine 21 and the coil exchanger 18 a tube or core magazine 22. Each tube or core magazine 21, 22 can receive eight coil cores or tubes. In the case at hand, conical coil tubes 23 having starting windings 24 are involved.

A tube or core loading station 25 is associated with the first machine side 1*a*. The tube loading station 25 has a tube or core supply 26 which has a complement of eight conical coil tubes or cores 27. In front of the tube or core supply 26, there is a core transporter 28 with eight core sliders 30*a* which are displaceable pneumatically in direction of the arrow 30. The core loading station 25 also includes a core elevator 32 and a preparation or make-ready station 33, wherein the initially empty coil cores are provided, in a conventional manner, with a starting winding of one to two layers. From there, the coil cores travel to the core supply 26.

The preparation station 33 carries a bracket 34 with a shaft 35 which is vertically disposed and is located in the central plane 2 of the machine. An arm 36 is pivotable through 180 degrees about the shaft 35 in direction of the curved arrow 37. The arm 36 carries an intermediate magazine 38. The intermediate magazine 38 is capable of accepting eight coil cores 39 at a time.

The intermediate magazine 38 has three normal positions or settings. The drawing shows the rest position thereof in solid lines. In the rest position, the intermediate magazine 38 is positioned outside of the travel regions of the two coil exchangers 17 and 18. If the arm 36 is swung clockwise 90 degrees out of the rest position thereof, the intermediate magazine 38 reaches the loading position 38*a* thereof, shown in phantom in the FIGURE. In the loading position 38*a*, the intermediate magazine 38 is located in front of the core supply 26, so that the conical coil cores 27 received in the core supply 26 can be slid by means of the core transporter 28 in to the intermediate magazine 38.

If the arm 36 is swung counterclockwise out of the rest position through 90 degrees, the intermediate magazine 38 reaches the transfer position 38*b* thereof. As soon as this has occurred, a further core transporter 29 which is fastened by an arm 41 thereof to a horizontally disposed shaft 40, can be swung upwardly into the position thereof shown by solid lines in the drawing. The eight identical core sliders 42 of the core transporter 29 can then be shifted pneumatically in direction of the arrow 31, whereby the coil cores received in the intermediate magazine 38 are delivered into the core magazine 22 of the coil exchanger 18.

Within the pivot range or region of the intermediate magazine 38, there is provided an interlocking device 43 which is actuatable by the intermediate magazine 38 and includes a latch 45, two guides 47 and 48 and a stop 51. The latch 45 has a resilient entrainer 53. If the intermediate magazine 38 is swung clockwise about the axis 35, the latch 45 moves into the pivot range of the first coil exchanger 17, so that this coil exchanger 17 cannot travel to the core loading station 25. When the intermediate magazine 38 is swung back into the solid-line rest position thereof counterclockwise into the transfer position thereof, then the stop 51 prevents further sliding of the latch 45. The resilient entrainer 53 gives way.

Within the displacement region of the first coil exchanger 17, there is provided an interlocking device 44 which includes a latch 46, two guides 49 and 50 and a stop 52. The latch 46 has a resiliently suspended entrainer 54. If the first coil exchanger 17 then travels toward the core loading station 25, a projection 55 extending from the core magazine 21 slides the entrainer 54 ahead, so that the latch 46 reaches the pivot region of the intermediate magazine 38. The intermediate magazine 38 can then no longer be swung in direction toward the core loading station 25. Only when the coil exchanger 17 has slid back the latch 46 during the return thereof is the pivot region of the intermediate magazine 28 unlatched again.

If the coil exchanger 17 requires coil cores, which is ascertained, for example, by a sensor 56, the coil exchanger 17 travels to the core loading station 25 by means of a motor 62 which acts on a roller 60 through a slipping clutch 57, accordingly latches or locks the intermediate magazine 38 and releases the loading mechanism at the loading station 25 by actuating a sensor 65 which turns an air pump 68 on. The coil transporter 28 slides the coil cores 27 into the core magazine 21 of the coil exchanger 17. Then the coil exchanger 17 travels back again and continues the coil exchanging function thereof.

If the need for coil cores is ascertained, for example, by a sensor 66, the second coil exchanger 18 travels to the end of the machine side 1*b*, into the position thereof shown in the FIGURE, by means of a motor 63 acting on the roller 61 through a friction clutch 58. In this position, the second coil exchange 18 actuates a sensor 67 which switches on, through a friction clutch 59 and a miter or bevel gear drive 70, a motor 64 acting on the arm 36, so that the intermediate magazine 38 is swung out of the solid-line rest latter position, the arm 36 actuates a sensor 71 which switches on, through a friction clutch 73, the motor 74 acting on the shaft 40. The core transporter 29 is thereby swung upwardly, until the core sliders 42 thereof are disposed in front of the coil cores 39 of the intermediate magazine 38, as shown in the FIGURE of the drawing. Then, the core transporter 29 is activated after the air pump 69 is switched on and slides all the core sliders 42 in direction of the arrow 31, whereby the coil cores 39 are transferred from the intermediate magazine 39 to the core magazine 22 of the second coil exchanger 18. Thereafter, the core transporter 29 is swung downwardly again, whereupon the intermediate magazine 38 is swung back into the solid-line rest position thereof again, so that the second coil exchanger can travel back and resume the coil exchanging function thereof. The intermediate magazine 38 is then swung from the rest position thereof, contrlled by a sensor 72 which determines the need for cores, clockwise into the loading position 38*a* thereof and, by actuating the sensor 65, releases the loading mechanism at the core loading station 25. Thereupon, the coil cores received in the core supply 26 are slid by the core transporter 28 into the intermediate magazine 38. As soon as this has happened, the intermediate magazine 38 swings back counterclockwise into the rest position thereof. The core supply 26 of the tube loading station 25 is automatically replenished with coil cores after each removal of cores therefrom.

As mentioned hereinbefore, the invention is not limited to the embodiment shown and described herein. The second core transporter 29 could alternatively be connected to the arm 36 and thus disposed so as to be pivotable about the axis 35. The interlocks could alternatively be electrical, pneumatic, hydraulic or other conventional devices.

There are claimed:

1. Double-sided textile machine with cheese-winding devices comprising a separate, traveling automatic coil exchanger associated with each of the sides of the textile machine, a coil-core magazine entrainable by each of the coil exchangers, and a common coil-core loading station located at an end of the machine for supplying the coil-core magazines of both of said coil exchangers with coil cores.

2. Double-sided textile machine according to claim 1 wherein said core loading station is disposed so as to directly supply coil cores to the core magazine of the coil exchanger associated with one of the sides of the textile machine, and including an intermediate magazine for supplying coil cores to the core magazine of the coil exchanger associated with the other of the sides of the textile machine, said intermediate magazine being pivotable about a vertical axis into respective positions at the one machine side whereat it is loadable with coil cores by said core loading station and at the other machine side whereat coil cores are unloadable therefrom in a manner that the tips of the coil cores when being unloaded extend in a direction opposite that of the tips of the coil cores when being loaded.

3. Double-sided textile machine according to claim 2 including a coil-core transporter associated with said intermediate magazine and pivotable into displacement range of one of said coil exchangers for transferring coil cores from said intermediate magazine into the coil-core magazine of said one coil exchanger.

4. Double-sided textile machine according to claim 2 wherein said intermediate magazine has three normal set positions, namely, a loading position wherein it is disposed within displacement range of said coil exchanger associated with the one side of the textile machine in front of said core loading station, a rest position into which it is pivotable through substantially 90° from said loading position thereof and is disposed beyond displacement ranges of both said coil exchangers respectively associated with the two sides of the textile machine, and a transfer position wherein it is disposed within the displacement range of said coil exchanger associated with the other side of the textile machine in readiness for transfer.

5. Double-sided textile machine according to claim 4 including a coil-core transporter associated with said intermediate magazine and pivotable into displacement range of said coil exchanger associated with the other side of the textile machine for transfering coil cores from said intermediate magazine into the coil-core magazine of said coil exchanger associated with the other side of the textile machine.

6. Double-sided textile machine according to claim 2 including a first latching device for one of said coil exchangers, said first latching device being disposed within pivot range of said intermediate magazine and actuatable by said intermediate magazine, and a second latching device for said intermediate magazine, said second latching device being disposed within displacement range of said one coil exchanger and actuatable by said one coil exchanger.

7. Double-sided textile machine according to claim 4 including a first latching device for said coil exchanger associated with the one side of the textile machine, said first latching device being disposed within pivot range of said intermediate magazine and being actuatable by said intermediate magazine, and a second latching device for said intermediate magazine, said second latching device being disposed within displacement range of said coil exchanger associated with the one side of the textile machine and being actuatable by said coil exchanger associated with the one side of the textile machine.

* * * * *